US006102085A

United States Patent [19]

Nanaji

[11] Patent Number: 6,102,085

[45] Date of Patent: Aug. 15, 2000

[54] HYDROCARBON VAPOR SENSING

[75] Inventor: Seifollah S. Nanaji, Greensboro, N.C.

[73] Assignee: Marconi Commerce Systems, Inc., Greensboro, N.C.

[21] Appl. No.: 09/188,860

[22] Filed: Nov. 9, 1998

[51] Int. Cl.[7] ..... B65B 1/04

[52] U.S. Cl. ..... 141/83; 141/59

[58] Field of Search ..... 141/83, 59, 94; 73/23.2, 31.07

[56] References Cited

U.S. PATENT DOCUMENTS

| | | | |
|---|---|---|---|
| 4,016,524 | 4/1977 | Pompei et al. | 338/34 |
| 4,166,485 | 9/1979 | Wokas | 141/52 |
| 4,459,139 | 7/1984 | vonReis et al. | 55/189 |
| 4,469,149 | 9/1984 | Walkey et al. | 141/94 |

(List continued on next page.)

5,843,212 12/1998 Nanaji .

FOREIGN PATENT DOCUMENTS

| | | |
|---|---|---|
| 0 653 376 A1 | of 1995 | European Pat. Off. . |
| 2 206 561 | of 1989 | United Kingdom . |
| 2 316 060 | of 1998 | United Kingdom . |

OTHER PUBLICATIONS

CARB Workshop Notice dated Feb. 9, 1994; Regulatory Measures to Control Refueling Emissions Through Vehicle–Based (OnBoard) Control . . . , Fill–Pipe, and Nozzle Specifications.

CARB Mail–Out #94–23 dated May 27, 1994; Staff's Proposed Recommendation For The Adoption Of The United States Environmental Protection Agency's Vehicle Refueling Standard And Test Procedures.

1996 Scientific Honeyweller article entitled Microsensors For Fluid Properties.

Geotechnical Instruments Limited article entitled Portable Hydrocarbon Analyser, Copyright 1997, retrieved from the internet.

Telaire Europe AB article entitled AirTell 2001VTC; Copyright 1997, retrieved from the internet.

Telaire Europe AB article entitled Vento Thermostat Model 2001VT, Copyright 1997, from the internet.

Critical Issued, vol. 3, No. 1, article entitled ORVR/Stage II Compatibility: Keeping Onboard and Vac–Assisted Systems From Pulling in Opposite Directions, Copyright 1997.

Cal/EPA Workshop—Vapor Recovery Procedures dated Oct. 6, 1997.

Cal EPA Air Resources Board, Vapor Recovery Test Procedure, Draft TP–201.29 dated Oct. 6, 1997.

Letter and Diagrams from Adsistor Technology, Inc. dated Feb. 12, 1998.

Gilbarco, Inc literature entitled VaporVac Vacuum assist Vapor Recovery dated 1993.

Information from Chrysler Corporation entitled Integrated Refueling/Evaporative Emissions Control System with Liquid Seal Refueling Vapor Control, undated.

Telaire Europe; AirTel 2001 VTC information; Copyright 1997.

*Primary Examiner*—Steven O. Douglas
*Attorney, Agent, or Firm*—Coats & Bennett, P.L.L.C.

[57] ABSTRACT

An apparatus for sensing the hydrocarbon concentration of the return vapor flow of a fuel dispenser equipped with a vapor recovery system. The apparatus includes a sensing housing positioned adjacent the vapor return passage so as to provide fluid communication with the return vapor flow and to discourage entry of liquid into the sensing housing and a vapor inlet positioned in the vapor return passage for admitting hydrocarbon vapor into the sensor chamber. Desirably, the sensing housing is angled to the vapor flow within the vapor return passage.

21 Claims, 5 Drawing Sheets

U.S. PATENT DOCUMENTS

| | | | |
|---|---|---|---|
| 4,515,606 | 5/1985 | de Winter | 55/159 |
| 4,745,796 | 5/1988 | Abdelrahman et al. | 73/26 |
| 4,821,908 | 4/1989 | Yost | 220/86 |
| 4,838,323 | 6/1989 | Watts | 141/1 |
| 4,887,578 | 12/1989 | Woodcock et al. | 123/519 |
| 4,944,273 | 7/1990 | Baresel et al. | 123/440 |
| 4,995,974 | 2/1991 | Lorey et al. | 210/247 |
| 5,017,538 | 5/1991 | Takeshima | 502/64 |
| 5,053,774 | 10/1991 | Schuermann et al. | 342/44 |
| 5,079,944 | 1/1992 | Boenning et al. | 73/23.4 |
| 5,109,442 | 4/1992 | Klainer et al. | 385/12 |
| 5,134,875 | 8/1992 | Jensen et al. | 73/1 |
| 5,143,696 | 9/1992 | Haas et al. | 422/90 |
| 5,150,603 | 9/1992 | Boenning et al. | 73/31.05 |
| 5,165,379 | 11/1992 | Thompson | 123/520 |
| 5,209,275 | 5/1993 | Akiba et al. | 141/83 |
| 5,226,309 | 7/1993 | Stetter et al. | 73/31.06 |
| 5,249,612 | 10/1993 | Parks et al. | 141/219 |
| 5,273,087 | 12/1993 | Koch et al. | 141/94 |
| 5,296,196 | 3/1994 | Takeshima | 422/98 |
| 5,316,057 | 5/1994 | Hasselmann | 141/94 |
| 5,319,199 | 6/1994 | Stedman et al. | 250/338.5 |
| 5,341,128 | 8/1994 | Keyser et al. | 340/605 |
| 5,341,129 | 8/1994 | Keyser et al. | 340/605 |
| 5,372,785 | 12/1994 | Johnson et al. | 422/90 |
| 5,444,249 | 8/1995 | Wong | 250/343 |
| 5,450,883 | 9/1995 | Payne et al. | 141/59 |
| 5,452,076 | 9/1995 | Schopper et al. | 356/128 |
| 5,476,125 | 12/1995 | Mitchell | 141/59 |
| 5,507,325 | 4/1996 | Finlayson | 141/83 |
| 5,514,338 | 5/1996 | Simon et al. | 422/82.02 |
| 5,562,133 | 10/1996 | Mitchell | 141/206 |
| 5,594,162 | 1/1997 | Dolan et al. | 73/46 |
| 5,605,182 | 2/1997 | Oberrecht et al. | 141/94 |
| 5,616,828 | 4/1997 | Kuczenski | 73/38 |
| 5,782,275 | 7/1998 | Hartsell, Jr. et al. | 141/94 |

HYDROCARBON VAPOR SENSING

FIELD OF THE INVENTION

The present invention relates generally to sampling vapor streams for concentrations of hydrocarbons contained therein. The invention is particularly suited for detecting hydrocarbon levels in fuel dispenser vapor return passages and the protection of hydrocarbon sensors from contamination by liquid hydrocarbon.

BACKGROUND OF THE INVENTION

For the past several years, the Environmental Protection Agency has had regulations to limit the amount of fuel vapor released into the atmosphere during the refueling of a motor vehicle. During a conventional or standard fueling operation, incoming fuel displaces fuel vapor from the head space of a fuel tank and out through the filler pipe into the atmosphere if not contained and recovered. The air pollution resulting from this situation is undesirable. Currently, many fuel dispensing pumps at service stations are equipped with vapor recovery systems that collect fuel vapor vented from the fuel tank filler pipe during the fueling operation and transfer the vapor to a fuel storage tank.

Recently, onboard, or vehicle carried, fuel vapor recovery and storage systems (commonly referred to as onboard recovery vapor recovery or ORVR) have been developed in which the head space in the vehicle fuel tank is vented through an activated charcoal-filled canister so that the vapor is adsorbed by the activated charcoal. Subsequently, the fuel vapor is withdrawn from the canister into the engine intake manifold for mixture and combustion with the normal fuel and air mixture. The fuel tank head space must be vented to enable fuel to be withdrawn from the tank during vehicle operation.

In typical ORVR systems, a canister outlet is connected to the intake manifold of the vehicle engine through a normally closed purge valve. The canister is intermittently subjected to the intake manifold vacuum with the opening and closing of the purge valve between the canister and intake manifold. A computer which monitors various vehicle operating conditions controls the opening and closing of the purge valve to assure that the fuel mixture established by the fuel injection system is not overly enriched by the addition of fuel vapor from the canister to the mixture.

Fuel dispensing systems having vacuum assisted vapor recovery capability which are unable to detect ORVR systems will continue to operate even though there is no need to do. This can waste energy, increase wear and tear, ingest excessive air into the underground storage tank and cause excessive pressure buildup in the underground storage tank due to the expanded volume of hydrocarbon saturated air. Recognizing an ORVR system and adjusting the fuel dispenser's vapor recovery system accordingly eliminates the redundancy associated with operating two vapor recovery systems for one fueling operation. The problem of incompatibility of assisted vapor recovery and ORVR was discussed in "Estimated Hydrocarbon Emissions of Phase II and Onboard Vapor Recovery Systems" dated Apr. 12, 1994, amended May 24, 1994, by the California Air Resources Board. That paper suggests the use of a "smart" interface on a nozzle to detect an ORVR vehicle and close one vapor intake valve on the nozzle when an ORVR vehicle is being filled.

Adjusting the fuel dispenser's vapor recovery system will mitigate fugitive emissions by reducing underground tank pressure. Reducing underground tank pressure minimizes the "breathing" associated with pressure differentials between the underground tank and ambient pressure levels. If the vacuum created by the fuel dispenser's vapor recovery system is not reduced or shut off, the underground tank pressure will increase to the extent that hydrocarbons are released through a pressure vacuum valve or breathing cap associated with the underground tank. In certain applications, reducing the vacuum created by the fuel dispenser's vapor recovery system when an ORVR system is detected permits the ingestion of a volume of air into the underground tank. When saturated with hydrocarbons, the volume of air expands to a volume approximately equal to the volume of fuel dispensed. Adjusting the fuel dispenser's vapor recovery system in this manner minimizes breathing losses associated with the underground tank.

A system and method for doing so is disclosed in commonly assigned U.S. Pat. No. 5,782,275 the disclosure of which is incorporated herein by reference. If the apparatus of the '275 patent detects an onboard system, it could either shut off the vapor pump completely, or control the pump to supply the amount of air to the storage tank needed to replenish the volume of liquid taken from the underground tank and thus eliminate breathing losses. The apparatus of the '275 patent includes a hydrocarbon sensor mounted in the vapor return passage of the hose used to fuel the vehicle. Further developmental work on the concept of hydrocarbon vapor sensing has revealed that the optimal point for monitoring the hydrocarbon concentration of vapors returning to the underground fuel tank may be within the dispenser.

There are potential difficulties associated with mounting a hydrocarbon sensor in the vapor return path of coaxial fuel delivery hose. These difficulties include addressing fire safety code requirements for an intrinsically safe device and routing sensor wiring through the hose. Moreover, dispenser hoses are equipped with "break away" fittings designed to cope with consumers who drive away from dispensers with a nozzle still in the vehicle fill pipe. Any type of wiring within the hose would have to be designed to be severable without generating a spark that could cause fire. Solving these technical problems could be expensive; accordingly, it would be advantageous to use a less expensive option.

The present invention addresses these and other problems as discussed in detail below. It should be recognized that the present invention provides numerous advantages some of which may not be detailed herein but which will be readily apparent to one of ordinary skill.

SUMMARY OF THE INVENTION

The present invention provides several advantages for systems requiring the determination of hydrocarbon vapor concentration in a vapor recovery dispenser vapor return passage. The present invention provides for a fluid communication between a hydrocarbon sensor and the return vapor stream in such fashion that liquid contamination of the sensor is discouraged. The apparatus of the present invention is simple in construction, easy to install, and is low cost.

The present invention provides the advantages described above through an apparatus for sensing the hydrocarbon concentration of the return vapor flow of a fuel dispenser equipped with a vapor recovery system including a sensing housing positioned adjacent the vapor return passage so as to provide fluid communication with the return vapor flow and to discourage entry of liquid into the sensing housing and a vapor inlet positioned in the vapor return passage for admitting hydrocarbon vapor into the sensor chamber. In a preferred embodiment, the sensing housing is angled to the vapor flow within the vapor return passage the housing. The angle between the sensing housing and the return vapor flow desirably is between about 45 and about 60 degrees with an angle of about 45 degrees being preferred.

In alternative embodiment the present invention includes a venturi mounted in the vapor return passage such that the venturi draws a portion of the vapor flow through the vapor inlet into the sensor chamber. The sensor chamber houses a hydrocarbon sensor mounted therein for sensing the hydrocarbon concentration of the vapors traveling through the vapor return passage.

The present invention further relates to a fuel dispenser including a vapor recovery system having a vapor return passage for routing vapor flow from a vehicle to an underground tank the fuel dispenser including a sensing housing positioned adjacent the vapor return passage so as to provide fluid communication with the return vapor flow and to discourage entry of liquid into the sensing housing. The dispenser also includes a vapor inlet positioned in the vapor return passage for admitting hydrocarbon vapor into the sensor chamber.

The practice of the present invention further includes monitoring either the hydrocarbon content or the oxygen content of the return vapor flow. The content of each of these components can be related to the other so that even if the vapor recovery system expects data regarding hydrocarbon content, then an oxygen content sensor may be used. The information regarding oxygen content would be converted to hydrocarbon content for use with such a system. Obviously, the opposite approach may be taken for a system expecting oxygen content information. Thus, a broader aspect of the present invention includes using a vapor sensor to monitor the return vapor flow. This vapor sensor may be a hydrocarbon sensor or may be an oxygen sensor.

These advantages and aspects of the present invention will become apparent to those skilled in the art after a reading of the following description of the preferred embodiments. Although the detailed written description details some of these items, other advantages and problems solved by the present invention and not necessarily stated herein will be readily apparent to one of ordinary skill.

It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The above and other objects, features, and advantages of the present invention will be more clearly understood from the following detailed description taken in conjunction with the accompanying drawings, in which.

DESCRIPTION OF THE PREFERRED EMBODIMENTS

Figure 1:
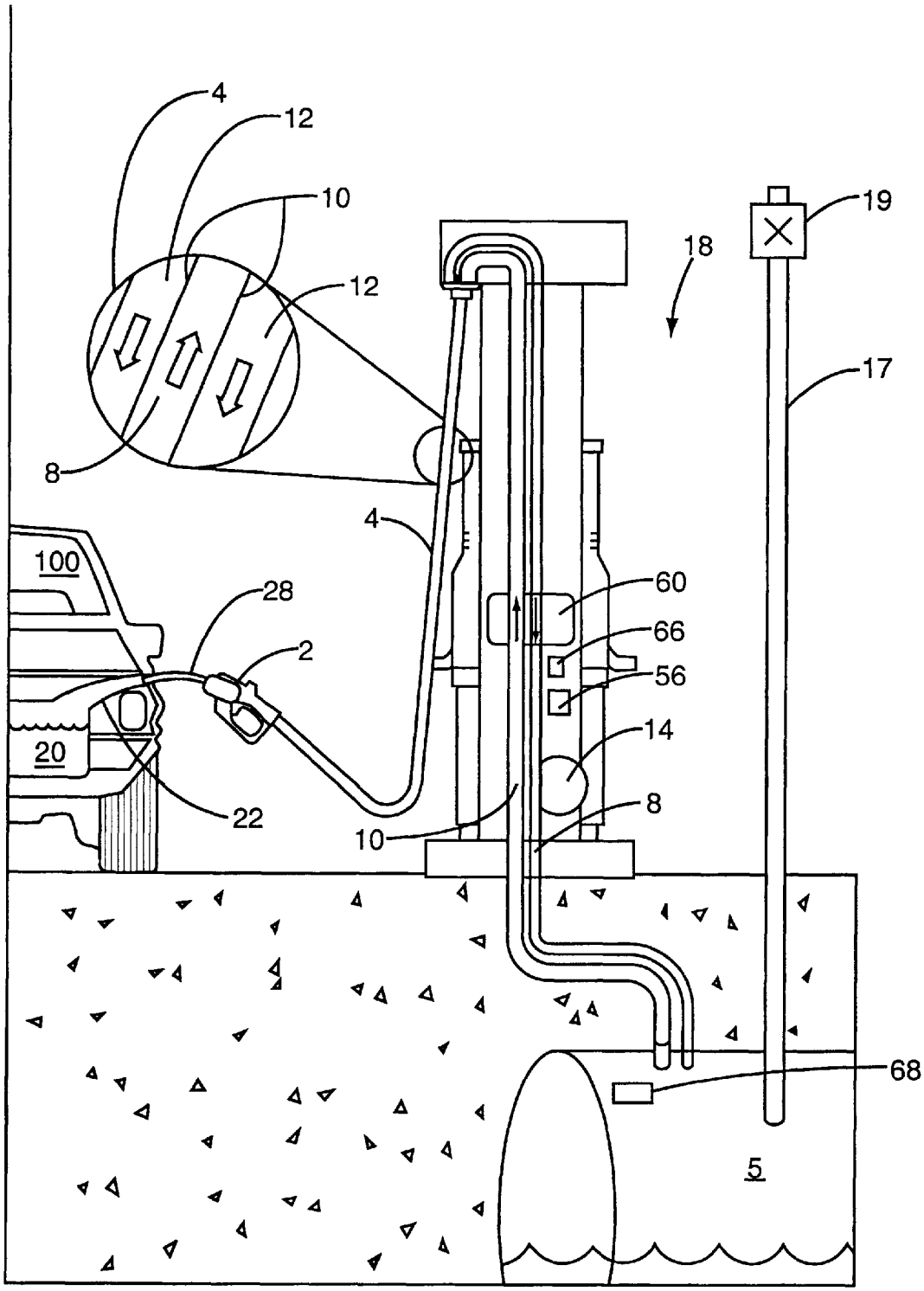
FIG. 1 is an elevational and partial sectional view of a typical gasoline dispenser installation having a vapor recovery system.

Referring now to the drawings in general and FIG. 1 in particular, it will be understood that the illustrations are for the purpose of describing a preferred embodiment of the invention and are not intended to limit the invention thereto. As best seen in FIG. 1, in a typical service station, an automobile 100 is shown being fueled from a gasoline dispenser or pump 18. A spout 28 of nozzle 2 is shown inserted into a filler pipe 22 of a fuel tank 20 during the refueling of the automobile 100.

A fuel delivery hose 4 having vapor recovery capability is connected at one end to the nozzle 2, and at its other end to the fuel dispenser 18. As shown by the cutaway view of the interior of the fuel delivery hose 4, an annular fuel delivery passage 12 is formed within the fuel delivery hose 4 for distributing liquid gasoline pumped from an underground storage tank 5 to the nozzle 2. Also within the fuel delivery hose 4 is a tubular vapor recovery passage 8 that normally transfers fuel vapors expelled from the vehicle's fuel tank 20 to the underground storage tank 5. The fuel delivery hose 4 is depicted as having an internal vapor recovery hose 10 for creating the vapor recovery passage 8. The fuel delivery passage 12 is formed between the hose 10 and hose 4. The terms vapor recovery passage and vapor return passage as used herein are defined to mean the entire flow path along which vapors recovered from a vehicle travel as they are returned to a storage point. One such storage point is an underground tank, however, other types of storage points to include intermediate vapor collection devices may also be used. Thus, any device installed in a vapor return passage may be installed at any along the path described above.

A vapor recovery pump 14 provides a vacuum in the vapor recovery passage 8 for removing fuel vapor during a refueling operation. The vapor recovery pump 14 may be placed anywhere along the vapor recovery passage 8 between the nozzle 2 and the underground fuel storage tank. The vapor recovery system using the pump 14 may be any suitable system such as those shown in U.S. Pat. No. 5,040,577 to Pope, U.S. Pat. No. 5,195,564 to Spalding, U.S. Pat. No. 5,333,655 to Bergamini et al., or U.S. Pat. No. 3,016,928 to Brandt. Various ones of these systems are now in commercial use, recovering vapor during refueling of conventional, non-ORVR vehicles.

As shown in FIG. 1, the underground tank 5 includes a vent 17 and a pressure-vacuum vent valve 19 for venting the underground tank 5 to atmosphere. The vent 17 and vent valve 19 allow the underground tank 5 to breathe in order to substantially equalize the ambient and tank pressures. In typical applications, maintaining tank pressure between the limits of pressure and vacuum is sufficient. Typical ranges of pressure and vacuum will range between +3 inches of water to −8 inches of water.

Figure 2:
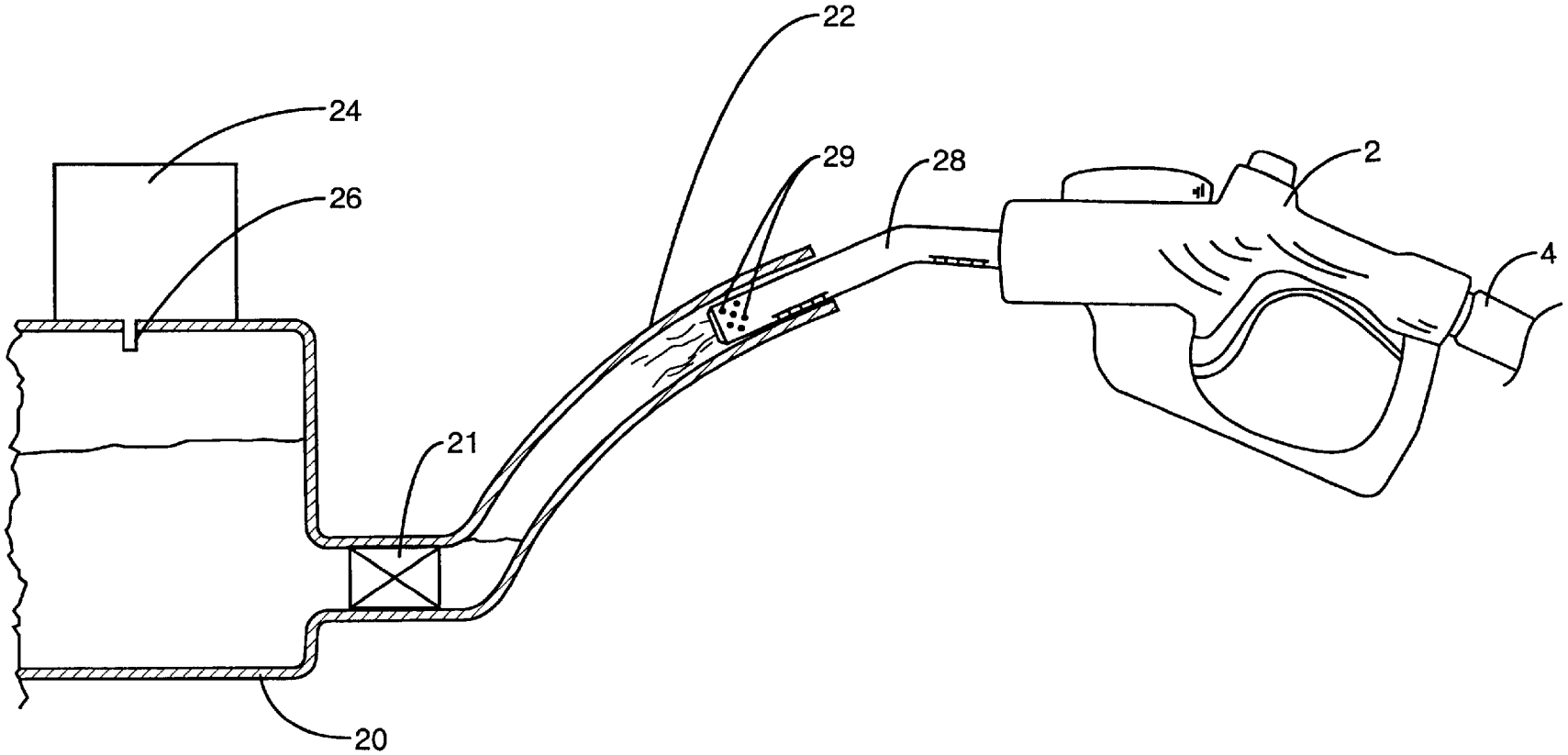
FIG 2 depicts a typical vacuum assist vapor recovery nozzle and the cross section of a fuel tank of a vehicle equipped with onboard recovery vapor recovery.

Turning now to FIG. 2, there is illustrated a schematic representation of a vehicle fuel tank 20 of an ORVR vehicle having an associated onboard vapor recovery system 24. These onboard vapor recovery systems 24 typically have a vapor recovery inlet 26 extending into the tank 20 (as shown) or the filler pipe 22 and communicating with the vapor recovery system 24. In the ORVR system of FIG. 2, incoming fuel provides a temporary seal in fill neck 22 to prevent vapors from within the tank 20 to escape. This sealing action is often referred to as a liquid seal. As the tank fills, pressure within tank 20 increases and forces vapors into the vapor recovery system 24 through the vapor recovery inlet 26. Other ORVR systems may use a check valve 21 along the fill neck 22 to prevent further loss of vapors. The check valve 21 is normally closed and opens when a set amount of gasoline accumulates over the check valve within the fill neck 22.

The spout 28 of the nozzle 2 has numerous apertures 29. The apertures 29 provide an inlet for fuel vapors to enter the vapor recovery path 8 of fuel dispenser 18 from the vehicle's filler pipe 22. As liquid fuel rushes into the fuel tank 20 during a fueling of a vehicle not equipped with an ORVR system, fuel vapors are forced out of the fuel tank 20 through the fill pipe 22. The fuel dispenser's vapor recovery system pulls fuel vapor through the vapor recovery apertures 29, along the vapor recovery path 8 and ultimately into the underground tank 5 (as shown in FIG. 1).

As discussed above, an apparatus for determining the presence of a vehicle having a vapor recovery system is disclosed in U.S. Pat. No. 5,782,275, the contents of which are incorporated herein by reference. This system includes a sensor for determining the hydrocarbon concentration in the vapor recovery passage 8. It would be desirable to mount the hydrocarbon sensor in a location that is protected from weather and that does not present the engineering challenge of mounting a sensor within a hose. The side column of a typical high-hose gasoline dispenser, such as the Gilbarco MPD® series of dispensers, has been found to meet these requirements. Other dispensers typically will have comparable suitable locations. The side columns typically include a vertical length of vapor return piping that forms part of the vapor recovery passage 8 shown in FIG. 1. During fuel dispensing, slugs of liquid gasoline pass through this portion of the vapor recovery passage 8 with some frequency. It is believed that one cause of the presence of this liquid is the "topping off" of a vehicle fuel tank 20. The topping off causes fuel to splash back into the fill pipe 22 to the extent that it floods the apertures 29 in nozzle spout 28. The vacuum generated by vapor recovery pump 14 can be strong enough to pull this liquid from the nozzle through the vapor return piping in the dispenser. Thus any hydrocarbon sensor installation in the dispenser vapor return piping directly in the vapor return path will be flooded with liquid hydrocarbon. It will be readily appreciated that this flooding may render the sensor inoperative, or at least, inaccurate.

The present invention addresses this problem by providing a sensor installation that provides vapor and fluid communication between the hydrocarbon sensor and the vapor passing through the vapor passage 8 without exposing the sensor to damaging liquid hydrocarbon contact. In its broadest sense the present invention provides a sensing chamber adjacent the vapor return passage. The sensing chamber is oriented such that it admits vapors while resisting the entry of substantially all liquid that may be present in the vapor passage 8.

Figure 3:
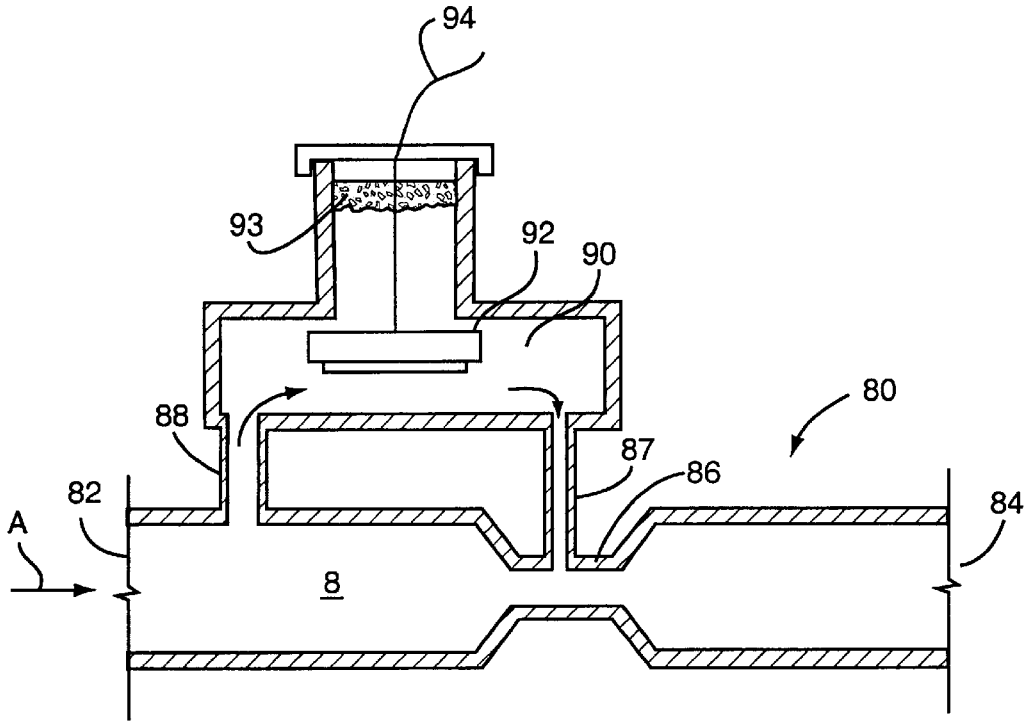
FIG. 3 is a schematic representation of a fueling dispenser vapor return line showing the installation of a hydrocarbon vapor sensor that uses a venturi device to admit a portion of a return vapor flow into contact with a hydrocarbon sensor.

FIG. 3 illustrates a venturi embodiment 80 of the present invention. Vapors enter the sensor apparatus at 82 and exit at 84. The direction of vapor travel through the apparatus is indicated by arrows A. Positioned between inlet 82 and outlet 84 is venturi 86. The pressure differential created as a vapor travels through the constricted passage of venturi 86 creates a suction in suction line 87. Sensing housing 90 defines a sensor chamber 91 and is positioned adjacent and, in this embodiment, substantially parallel to vapor passage 8. The chamber 90 is in fluid communication with vapor passage 8 via suction line 87 and vapor inlet 88. The low pressure suction created by venturi 86 draws vapors through vapor inlet 88 into sensing chamber 90 in contact with hydrocarbon sensor 92. The vapor is then returned to vapor passage 8 via suction line 87. Hydrocarbon sensor 92 communicates with the dispenser vapor recovery control system via electrical lead 94. Safety code requirements dictate that an intrinsically safe vapor seal 93 be provided to seal electrical lead 94 and to prevent the escape of vapors into the dispenser housing. Desirably, sensing chamber 90 is of a cylindrical shape although other shapes may be used. Sensing chamber 90 may be tilted out of parallel with vapor passage 8 in some installations to promote drainage of any condensation that may collect inside sensing chamber 90.

This embodiment provides for a controlled sampling of the vapor stream in vapor return passage 8 while minimizing any exposure of sensor 92 to direct contact with liquid hydrocarbon. Use of the venturi 86 takes advantage of the energy in the vapor stream to provide the motive power for drawing a continuous sample of the vapor into contact with sensor and returning the continuous sample vapor return passage 8. Despite the many advantages of the venturi approach, this approach does have some difficulties. First, the venturi structure must be built to exacting specifications in order to optimize its performance. This requirement may increase manufacturing costs.

Figure 4:
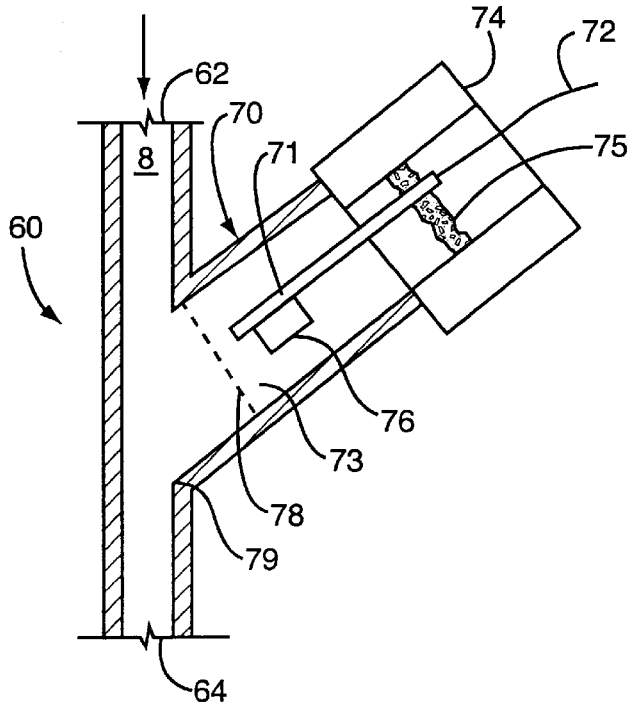
FIG. 4 is a schematic representation of a fueling dispenser vapor return line showing the installation of a hydrocarbon vapor sensor in a sensing housing so as to provide fluid communication with a return vapor flow.

An alternative embodiment is depicted in FIG. 4. Hydrocarbon vapors being returned to underground tank 5 pass through vapor inlet 62 and exit at vapor outlet 64. An angled hydrocarbon sensing housing 70 is mounted in fluid communication with vapor return passage 8. The sensing housing 70 is angled with respect to vapor return passage 8. Sensor chamber 73 is located within this angled housing 70 and is open for fluid communication with vapor return passage 8. Hydrocarbon sensor 76 is mounted on printed circuit board 71 and the combination is mounted within sensor chamber 73. A cap 74 that includes an intrinsically safe seal 75 is provided atop housing 70 to meet safety regulations. The hydrocarbon sensor 76 communicates with the dispenser vapor recovery system via electrical lead 72.

The positioning of hydrocarbon sensor 76 out of the path of the vapor return passage 8 shields the sensor 76 from substantially all the exposure to any liquid hydrocarbon. It will be readily appreciated that any liquid passing through the vapor return passage 8 is unlikely to make the severe turn required to enter the sensing chamber 73 and travel all the way to sensor 76. Nevertheless, vapors easily can fill sensing chamber 73. Experience with this configuration has indicated that sensing chamber 73 does not act as a "dead space" and that the vapor concentration in sensing chamber 73 accurately reflects that of the vapor return passage 8. That is, as the hydrocarbon vapor concentration rises and falls in vapor return passage 8, it also rises and falls in sensing chamber 73.

Despite the advantages of this design, very large slugs of hydrocarbon liquid can occasionally contaminate hydrocarbon sensor 76. In particular, an eddy effect created at the lower edge 79 of the vapor inlet can cause liquid to travel up the lower wall of sensing chamber 73. It is believed that this situation may be addressed by the inclusion of a filter 78 in sensing chamber 73. The function of this filter is to block or, alternatively, breakup any liquid entering sensing chamber 73. Desirably, the filter 78 is comprised of a hydrophobic material that resists the passage of liquid but permits vapor passage therethrough. These types of materials are well known to one of ordinary skill. Even more desirably, the filter is constructed of a hydrocarbonphobic material which is a material that has a particular ability to repel liquid hydrocarbon. Alternatively, the filter may be constructed of a coalescing mesh to perform the same function. The mesh would break the liquid up into small droplets and thus minimize any contamination effect on filter 76. The mesh filter would require periodic change outs as it is believed that the mesh will become covered with a varnish or gummy deposits left by the hydrocarbon vapor in similar fashion to the deposits that build up in the intake systems of an automobile engine.

Figure 5:
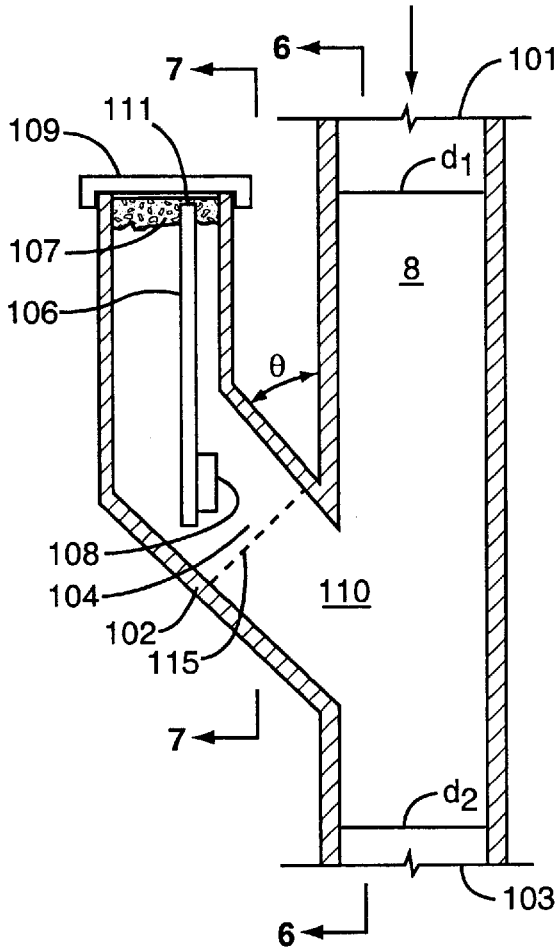
FIGS. 5 and 5A are schematic representation of a preferred embodiment of the angled sensing housing of the present invention.
Figure 6:
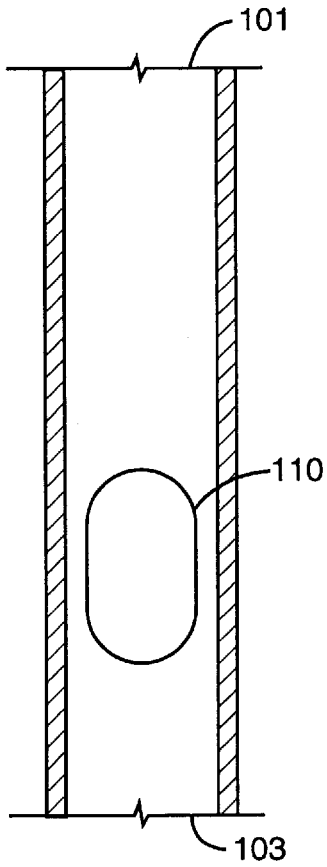
FIG. 6 is a cross sectional view taken along 6—6 in FIG. 6.
Figure 7:
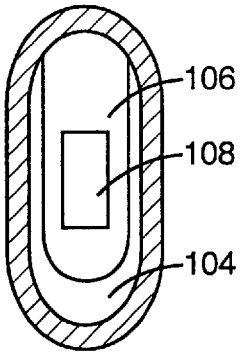
FIG. 7 is a cross sectional view taken along 7—7 in FIG. 6 to illustrate the positioning of the hydrocarbon sensor in the sensing chamber.

Turning now to FIGS. 5–7, there is illustrated a preferred embodiment of the present invention. This embodiment includes a sensing housing 102 which is in fluid communication with the return vapor flow in the vapor return passage 8. The housing 102 is provided with a seal 107 and cap 109. The sensor communicates with a dispenser vapor recovery system or other system via electrical lead 111.

This embodiment addresses sensor contamination by liquid hydrocarbon. Hydrocarbon vapors enter at vapor inlet 101 and exit via vapor outlet 103. Sensing housing 102 is angled with respect to the direction of vapor return passage 8. A housing angle θ is defined between sensing housing 102 and the vapor return passage 8. The housing angle refers to the angle between the sensing housing and the direction of vapor flow through the vapor return passage 8. The direction of vapor flow typically is a straight line defined between vapor inlet 101 and vapor outlet 103. Desirably the housing 102 is installed in a straight line section of the vapor return passage 8. Hydrocarbon sensor 108 is mounted on printed circuit board 106 and is positioned within sensing chamber 104. As was discussed above, a filter 115 may be provided in sensing chamber 104 if desired.

It has been found that liquid entry into sensing chamber 104 may be minimized through the selection of angle θ and the shape of vapor inlet 110. It will be appreciated that when the angle θ between the sensing housing and the vapor return passage 8 is 90°, the sensing housing 102 forms a T shape in relation to the vapor return passage 8. As that angle decreases towards 0, the sensing chamber 104 becomes more parallel to the direct of flow through vapor return passage 8. Moreover, the sensing chamber increasingly turns away from the vapor return passage 8 and associated vapor flow as the housing angle decreases. The housing angle should be selected to provide fluid communication between the sensing chamber 104 and the sensor 108. Desirably, it has been found that an optimal angle for providing proper fluid communication with the vapor return passage and discouraging fluid entry into the sensing chamber 104 is between about 45° and about 60°. This angle provides the best performance for admitting vapor while at the same time having a tendency to resist the entry of any liquid into sensing chamber 104. Other angles less than 45° also have this capability, but may tend to create an undesirable dead space in sensing chamber 104. As the housing angle increases from about 60° the tendency for liquid entry into sensing chamber 104 tend to increase. It should be understood than angles far above the range specified above may not provide the desired resistance to liquid entry into the sensing chamber 104.

Any difficulties with a housing angle of about 60° or greater may be addressed by varying the diameter of vapor return passage on either side of the sensing housing 102. The diameter of the vapor return passage 8 upstream of sensing housing 102 is shown as $d_1$ in FIG. 5. The diameter downstream of vapor sensing housing 102 is shown as $d_2$ Desirably, $d_2$ is configured to be substantially larger than $d_1$ so as to create a vapor "sink." then the liquid eddying problem is minimized. In a preferred embodiment the $d_2/d_1$ ratio is between about 1.25 and about 1.5.

Another factor affecting liquid entry is the shape of vapor inlet 110. In this preferred embodiment vapor inlet 110 and sensing chamber 104 have a substantially oval or, equivalently, a substantially elliptical shape. This shape is best illustrated in FIG. 6, which is a sectional view taken along 6—6 of FIG. 5. It is believed that the vapor inlet 110 should be provided with rounded comers or should exclude angled corners as experience has shown that the angled corners tend to accentuate the eddy effect described above. Other shapes may be used as well to include a circular vapor inlet opening. A substantially square vapor inlet 110 could be used so long as the right angle corners are rounded off with a radius sufficiently large to avoid liquid entry into the sensing chamber 104.

FIG. 7 is a cross sectional view taken along 7—7 in FIG. 5, and illustrates an enlarged view of the hydrocarbon sensor 108 positioned in the sensing chamber 104. Desirably, the lower edge of printed circuit board 106 is rounded to match the contour of the sensing chamber 104. Although the printed circuit board is shown positioned above the bottom of the sensing chamber 104, it may be lowered so that the lower edge of the printed circuit board 106 rests on the lower edge of the sensing chamber 104.

Figure 5A:
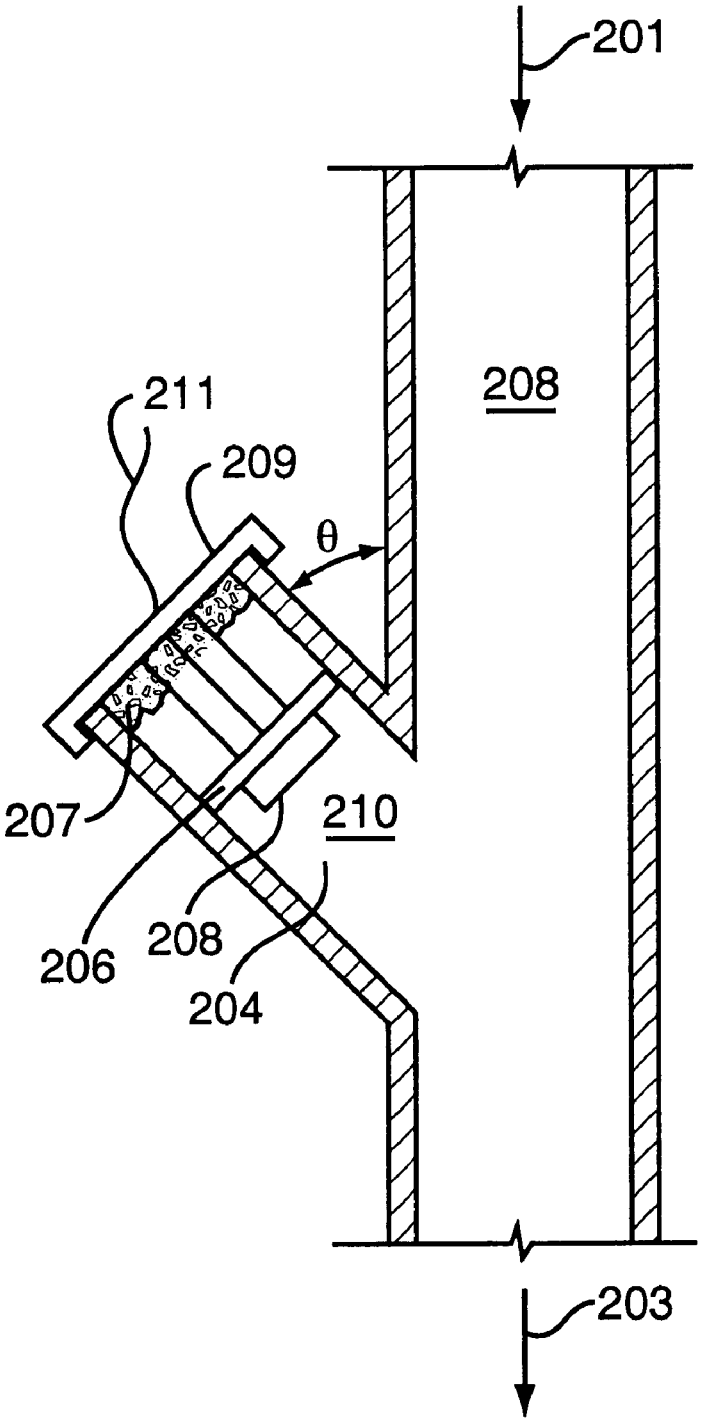

An alternative sensor placement in the sensing housing is illustrated in FIG. 5A. This embodiment includes a sensing housing 202 that is angled to the flow of vapor through vapor passage 208. The path taken by hydrocarbon vapors is indicated by arrows 201, 203. The sensing housing 202 includes vapor inlet 210 and sensor chamber 204. Sensor 208 is mounted on printed circuit board 206 which is in communication with other vapor recovery system components via electrical lead 211. A cap 209 and intrinsically safe seal 207 are provided to prevent the escape of hydrocarbon vapors from the sensing housing 202. This embodiment may further include a hydrophobic filter (not shown) as needed. The angle θ between sensor housing 202 and the direction of vapor flow through vapor return passage 208 will be the same as that described hereinabove.

Additional features may be added to the present invention to address condensation that may collect in sensing chamber 104 and on hydrocarbon sensor 108 during daily heating and cooling cycles experienced by dispenser 18. This condensation problem may be particularly troublesome in locations that experience large temperature swings between day and night. It is desirable to provide some means for heating the sensing chamber and/or the hydrocarbon sensor 108 and its printed circuit board 106 to deal with this condensation problem. One approach is to provide well known resistive heaters in printed circuit board 108. The heaters could be cycled on and off as needed by an electronic controller depending on the temperature sensed inside sensing chamber 104. This approach requires additional electronic components and efforts to meet safety code requirements for electrical installations in hazardous environments.

Another approach would be to provide a warming blanket around sensing housing 102. The operation of the warming blanket could be initiated in several ways. First, its operation could be controlled by a timer to cycle on and off at set times during the day or evening based on knowledge of local temperature patterns. The warming blanket would be energized at those times when condensation would be expected to collect and would operate for a long enough period to evaporate the condensation or to prevent its formation. Alternatively, the moisture level in the sensing chamber 104 could be monitored by moisture sensors which would activate the warming blanket as needed.

The practice of the present invention comprehends the installation of the sensor apparatus in both new fuel dispensers as they are being constructed and as a retrofit modification for dispensers already in service. Accordingly, the scope of the present invention includes a retrofit kit for a fuel dispenser having a vapor recovery system and vapor return passage 8. The kit may include a Y-shaped fitting and hydrocarbon sensor that are installed preferably in a vertical section of the vapor return piping within a fuel dispenser. The kit could comprise the fitting alone or, alternatively, could comprise the kit along with a hydrocarbon sensor installed therein.

The present invention includes providing a sensing housing positioned adjacent a dispenser vapor return passage so as to provide fluid communication with the return vapor flow in the passage and to discourage entry of liquid into the sensing housing. The practice of the present invention does not limit the orientation of a hydrocarbon sensor within the sensing housing and sensor chamber. Depending on the number of factors including throughput through the dispenser, local weather conditions, and the type of sensor used, a number of different sensor orientations may be used within the sensing housing. It follows that the sensor positioning illustrated herein is merely exemplary and not limiting of the present invention.

The present invention has been described herein with respect to certain embodiments and arrangements. The scope of the invention includes other such embodiments that provide for directing a flow of vapor through a vapor passage, admitting a portion of the vapor in the flow of vapor from the vapor passage to an adjacent sensing housing, while not admitting any appreciable amounts of liquid hydrocarbons. The invention further includes determining the presence of hydrocarbon in the diverted portion. The vapor flow potentially may contain hydrocarbons in vapor and/or liquid form.

Conversely, the practice of the present invention could include monitoring the return vapor flow for its oxygen content. It will be readily understood that any particular hydrocarbon content of the vapor flow has a corresponding oxygen content. That is, if the hydrocarbon content is 5% then the oxygen content must be 95%. Thus, the control of the vapor recovery system described herein above may be achieved by monitoring the oxygen content of the vapor flow as well as the hydrocarbon content thereof. A system for using vapor flow oxygen content in this fashion is disclosed in United Kingdom published patent application 2 316 060 ("the '060 patent publication"), the content of which is incorporated herein by reference. The '060 patent publication system relies on the expected increased oxygen content of the return vapor flow from an ORVR vehicle to halt operation of a vacuum pump. The system and method disclosed in the '275 patent could be adapted for use with an oxygen sensor by including an additional component that would convert information regarding oxygen content to hydrocarbon content. This component could include a hard wired device included as part of the sensor itself on printed circuit board 106,206, or, alternatively, software instructions contained in the vapor recovery system controller. In its broadest aspect then, the present invention includes the provision of a vapor sensor in fluid communication with the return vapor flow. This sensor could be a hydrocarbon sensor or an oxygen sensor.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

We claim:

1. An apparatus for sensing the hydrocarbon concentration of a vapor flow in a vapor return passage comprising:

a. a sensing housing positioned adjacent the vapor return passage so as to provide fluid communication with the vapor flow and to discourage entry of liquid into the sensing housing;

b. a vapor inlet positioned in the vapor return passage for admitting vapor into the sensing housing; and.

c. a hydrocarbon sensor mounted in a sensor chamber defined within the sensing housing.

2. A sensor apparatus according to claim 1 wherein the sensing housing is angled to the vapor flow within the vapor passage.

3. A sensor apparatus according to claim 1 wherein the angle between the sensing housing and the vapor flow is between about 45 and about 60 degrees.

4. A sensor apparatus according to claim 1 wherein the angle between the sensing housing and the vapor flow is about 45 degrees.

5. A sensor apparatus according to claim 1 further comprising a liquid filter positioned between the vapor inlet and the sensor chamber.

6. A sensor apparatus according to claim 5 wherein the liquid filter is a hydrophobic filter.

7. A sensor apparatus according to claim 5 wherein the liquid filter is a hydrocarbonphobic filter.

8. A sensor apparatus according to claim 5 wherein the liquid filter is a mesh coalescing filter.

9. A sensor apparatus according to claim 1 wherein the hydrocarbon sensor is a fiber optic sensor.

10. A sensor apparatus according to claim 1 wherein the hydrocarbon sensor is a resistive sensor.

11. A sensor apparatus according to claim 1 wherein the sensing chamber is substantially parallel to the direction of the vapor flow in the vapor return passage.

12. A sensor apparatus for sensing the hydrocarbon concentration of the return vapor flow of a fuel dispenser vapor return passage comprising:

a. a sensing housing positioned adjacent the vapor return passage so as to provide fluid communication with the return vapor flow and to discourage entry of liquid into the housing, the sensing housing being angled to the vapor flow at an angle between about 45 degrees and about 60 degrees;

b. a vapor inlet positioned in the vapor return passage for admitting hydrocarbon vapor into the sensing housing; and c. a hydrocarbon sensor mounted in the sensing housing for sensing the hydrocarbon concentration in the vapor return passage.

13. A fuel dispenser including a vapor recovery system having a vapor return passage for routing return vapor flow from a vehicle to an underground tank, the fuel dispenser comprising:

a. a sensing housing positioned adjacent the vapor return passage so as to provide fluid communication with the return vapor flow and to discourage entry of liquid into the sensing housing; and b. a vapor inlet positioned in the vapor return passage for admitting hydrocarbon vapor into the sensor chamber.

14. A fuel dispenser according to claim 13 wherein the sensing housing is angled to the return vapor flow such that the angle between the sensing housing and the return vapor flow is between about 45 degrees and about 60 degrees.

15. A method of sensing the presence of hydrocarbons in a vapor flow contained in a vapor passage comprising:

a. directing a flow of vapor potentially containing hydrocarbons in liquid and vapor form through a vapor passage;

b. admitting a portion of the vapor in the flow of vapor from the vapor passage to an adjacent sensing housing, while not admitting an appreciable amount of liquid hydrocarbons; and c. determining the presence of hydrocarbon in the diverted portion.

16. A method according to claim 15 wherein the adjacent sensing housing is angled to the vapor flow at an angle of between about 45 and about 60 degrees.

17. A method according to claim 15 wherein the adjacent sensing housing is angled to the vapor flow at an angle of about 45 degrees.

18. An apparatus for sensing the hydrocarbon or oxygen concentration of a vapor flow in a vapor passage comprising:

a. a sensing housing positioned adjacent the vapor passage so as to provide fluid communication with the vapor flow and to discourage entry of liquid into the sensing housing;

b. a vapor inlet positioned in the vapor passage for admitting vapor into the sensing housing; and.

c. a vapor sensor mounted in a sensor chamber defined within the sensing housing.

19. A sensor apparatus according to claim 18 wherein the sensing housing is angled to the vapor flow within the vapor passage.

20. An apparatus according to claim 19 wherein the vapor sensor is a hydrocarbon sensor.

21. An apparatus according to claim 19 wherein the vapor sensor is an oxygen sensor.

* * * * *